US006213083B1

(12) United States Patent
Winberg

(10) Patent No.: US 6,213,083 B1
(45) Date of Patent: Apr. 10, 2001

(54) FUEL SHUTOFF SYSTEM

(75) Inventor: James R. Winberg, Brookfield, WI (US)

(73) Assignee: Briggs & Stratton Corporation, Milwaukee, WI (US)

( * ) Notice: Subject to any disclaimer, the term of this patent is extended or adjusted under 35 U.S.C. 154(b) by 0 days.

(21) Appl. No.: 09/487,754

(22) Filed: Jan. 19, 2000

Related U.S. Application Data

(63) Continuation-in-part of application No. 08/780,338, filed on Jan. 8, 1997, now abandoned.

(51) Int. Cl.[7] ..... F02B 77/00
(52) U.S. Cl. ..... 123/198 DB; 123/198 DC
(58) Field of Search ..... 123/DIG. 11, 198 DC, 123/198 DB

(56) References Cited

U.S. PATENT DOCUMENTS

| | | |
|---|---|---|
| 1,473,303 | 11/1923 | Lightford . |
| 2,131,811 | 10/1938 | Kittredge . |
| 2,706,025 | 4/1955 | Halttunen . |
| 3,731,663 | 5/1973 | Hollins . |
| 3,897,771 | 8/1975 | Stumpp . |
| 4,050,436 | 9/1977 | Crabtree . |
| 4,077,381 | 3/1978 | Firey . |
| 4,078,536 | 3/1978 | Ozawa et al. . |
| 4,111,175 | 9/1978 | Nakamura et al. . |
| 4,111,176 | 9/1978 | Fenton et al. . |
| 4,161,639 | 7/1979 | Nofel . |
| 4,198,816 | 4/1980 | Hasegawa et al. . |
| 4,414,162 | 11/1983 | Li et al. . |
| 4,510,739 | 4/1985 | Dluhosch . |
| 4,577,597 | 3/1986 | Tomita . |
| 4,924,827 | 5/1990 | Minegishi . |
| 5,050,548 | 9/1991 | Minegishi . |
| 5,092,295 | 3/1992 | Kobayashi . |
| 5,301,644 | 4/1994 | Olmr . |
| 5,357,935 | 10/1994 | Oxley et al. . |
| 5,444,121 | 8/1995 | Kai . |
| 5,797,374 | 8/1998 | Minagawa et al. . |

*Primary Examiner*—John Kwon
(74) *Attorney, Agent, or Firm*—Michael Best & Friedrich LLP

(57) ABSTRACT

A fuel shutoff system that is usable on engines without a battery, and is inexpensive to manufacture. The fuel shutoff system operates without interfering with the engine governor, and effectively blocks the fuel flow downstream of the fuel bowl upon engine shutdown. One aspect of the invention is a fuel shutoff system for an internal combustion engine, wherein the engine has a carburetor with a fuel bowl and a fuel nozzle, an intake valve, and a fuel conduit between the fuel bowl and the intake valve. The invention includes a blocking member for selectively blocking the fuel conduit downstream of the fuel bowl to substantially prevent passage of fuel to the intake valve, and a manually-operable control for actuating the blocking member. In each embodiment, the engine includes a gas passageway through which a gas may pass to an intake valve of the engine, and the engine has a throttle valve disposed in the passageway, and the blocking member is distinct from the throttle valve. One embodiment of the invention includes a mechanically operated blocking member for selectively blocking fuel from flowing into the fuel nozzle. Another embodiment of the invention includes a blocking member disposed in the gas passageway. Another aspect of the invention is an ignition grounding system of the engine wherein the fuel shutoff system and the grounding system are both actuated by operation of the same mechanical means.

25 Claims, 11 Drawing Sheets

FUEL SHUTOFF SYSTEM

This application is a continuation-in-part of application Ser. No. 08/780,338, filed Jan. 8, 1997, now abandoned.

FIELD OF THE INVENTION

The present invention generally relates to the field of internal combustion engines and, more particularly, to internal combustion engines that utilize fuel shutoff systems upon engine shutdown.

BACKGROUND OF THE INVENTION

Internal combustion engines are used in a variety of applications, such as lawn mowers, generators, pumps, snow blowers, and the like. Such engines often have carburetors wherein fuel received from a fuel source is mixed with air and supplied to a combustion chamber for ignition. The fuel mixture is drawn from the carburetor into the combustion chamber due to a low pressure created in the combustion chamber by the rotation of the engine. The products of combustion are then expelled from the combustion chamber into the exhaust manifold during the exhaust stroke of the engine.

An operator of an engine may shut the engine down by grounding the electrical ignition system, thereby causing the spark plug to cease firing. After shutdown, the engine does not immediately stop rotating. During the continued rotation or coasting of the engine after ignition shutdown, unburned fuel and air are drawn from the carburetor into the combustion chamber, and expelled into the exhaust system.

The continued draw of unburned fuel into the combustion chamber and exhaust manifold after engine shutdown causes problems. Fuel is wasted, and unburned fuel is released into the environment, thereby increasing exhaust emissions. Additionally, the muffler or muffler with catalytic converter often get very hot, and the unburned fuel may ignite when it contacts these components, thereby causing backfiring or afterburning. Backfiring and afterburning can shorten the useful life of the catalytic converter and of the muffler itself. Likewise, the presence of unburned fuel in the combustion chamber may cause dieseling.

To alleviate these problems, fuel shutoff mechanisms have been devised to control the flow of fuel after ignition shutdown. For instance, U.S. Pat. No. 5,301,644 to Olmr discloses a fuel shutoff mechanism which includes a solenoid valve. However, the '644 system, as well as other apparatus which use solenoids, typically require a battery to function. The addition of a battery to engines adds to the weight and cost of the engine. Additionally, solenoids, or other electric actuating devices, are expensive and are expensive to replace. In the small utility engine industry, for example, the additional cost, weight, and complexity are very undesirable.

Other fuel shutoff devices, such as the one disclosed in U.S. Pat. No. 5,092,295 to Kobayashi, use the throttle of the engine to act as a fuel blocker upon engine shutdown. This is done by adding structure which overrides the governor of the engine and closes the throttle valve upon shutdown. The problem with these devices, however, is that they are complex, and must be added onto and may disturb the delicate balance of the engine governor.

Yet other devices, such as U. S. Pat. No. 4,510,739 to Dluhosch, use a fuel shutoff valve which stops the flow of fuel into the fuel bowl. The disadvantage of these devices is that a substantial amount of fuel remains in the fuel bowl after the engine ignition is shut down, and can still be drawn into the combustion chamber and exhaust system after shutdown.

SUMMARY OF THE INVENTION

The invention is a fuel shutoff system that solves the problems of the prior art. More particularly, the invention includes a fuel shutoff system that is usable on engines without a battery, and is reliable, simple and less expensive than electrically operated solenoids. Additionally, the fuel shutoff operates without interfering with the engine governor, and effectively blocks the fuel flow downstream of the fuel bowl on engine shutdown.

One aspect of the invention is a fuel shutoff system for an internal combustion engine, wherein the engine has a carburetor with a fuel bowl, an intake valve, and a fuel conduit between the fuel bowl and the intake valve. The invention includes a blocking member for selectively blocking the fuel conduit downstream of the fuel bowl to substantially prevent passage of fuel to the intake valve, and a manually-operable control for actuating the blocking member. In each embodiment, the engine includes a throttle and a fuel metering device, and the blocking member is distinct from the throttle and the fuel metering device calibration.

In one embodiment of the invention, the engine includes a carburetor having a fuel nozzle, and the fuel shutoff system includes a mechanically operated blocking member for selectively blocking fuel from flowing from the fuel bowl into the fuel nozzle. In one form, the blocking member is selectively positioned adjacent the fuel nozzle in a first position wherein the blocking member blocks the fuel from flowing into the fuel nozzle, and in a second position wherein the blocking member allows the fuel to flow into the fuel nozzle. By blocking the fuel flow downstream of the fuel bowl, restarting the engine is simplified. The fuel bowl does not have to be refilled before starting.

In another embodiment of the invention, the engine has a passageway through which a gas (the fuel/air mixture) may pass to an intake valve of the engine, and the engine has a throttle valve disposed in the passageway. The blocking member is disposed in the passageway and can be selectively positioned in a first open position, and in a second closed position upon engine shutdown to substantially block the flow of gas or fuel/air mixture to the intake valve and to the combustion chamber.

Another aspect of the invention is an ignition grounding device for grounding the ignition system of the engine wherein the fuel shutoff system and the grounding device are both actuated by the same mechanical operation.

An important feature and advantage of the invention is that the invention reduces the amount of unburned fuel which is wasted and released into the environment since all fuel flow is shut off upon engine shutdown.

Another feature and advantage of the invention is that the fuel shutoff, particularly at the fuel nozzle, enables the engine to be transported with fuel and oil without the fuel passing through the engine into the crankcase, thereby avoiding oil dilution and hydraulic lock.

Another feature and advantage of the invention is that the fuel shutoff, particularly at the fuel nozzle, enables the engine to be transported with fuel without the fuel flowing into the carburetor during transport, thereby avoiding the potential for engine flooding.

Other features and advantages of the invention will become apparent to those skilled in the art upon review of the following detailed description, claims and drawings.

DETAILED DESCRIPTION OF THE PREFERRED EMBODIMENTS

Figure 1:
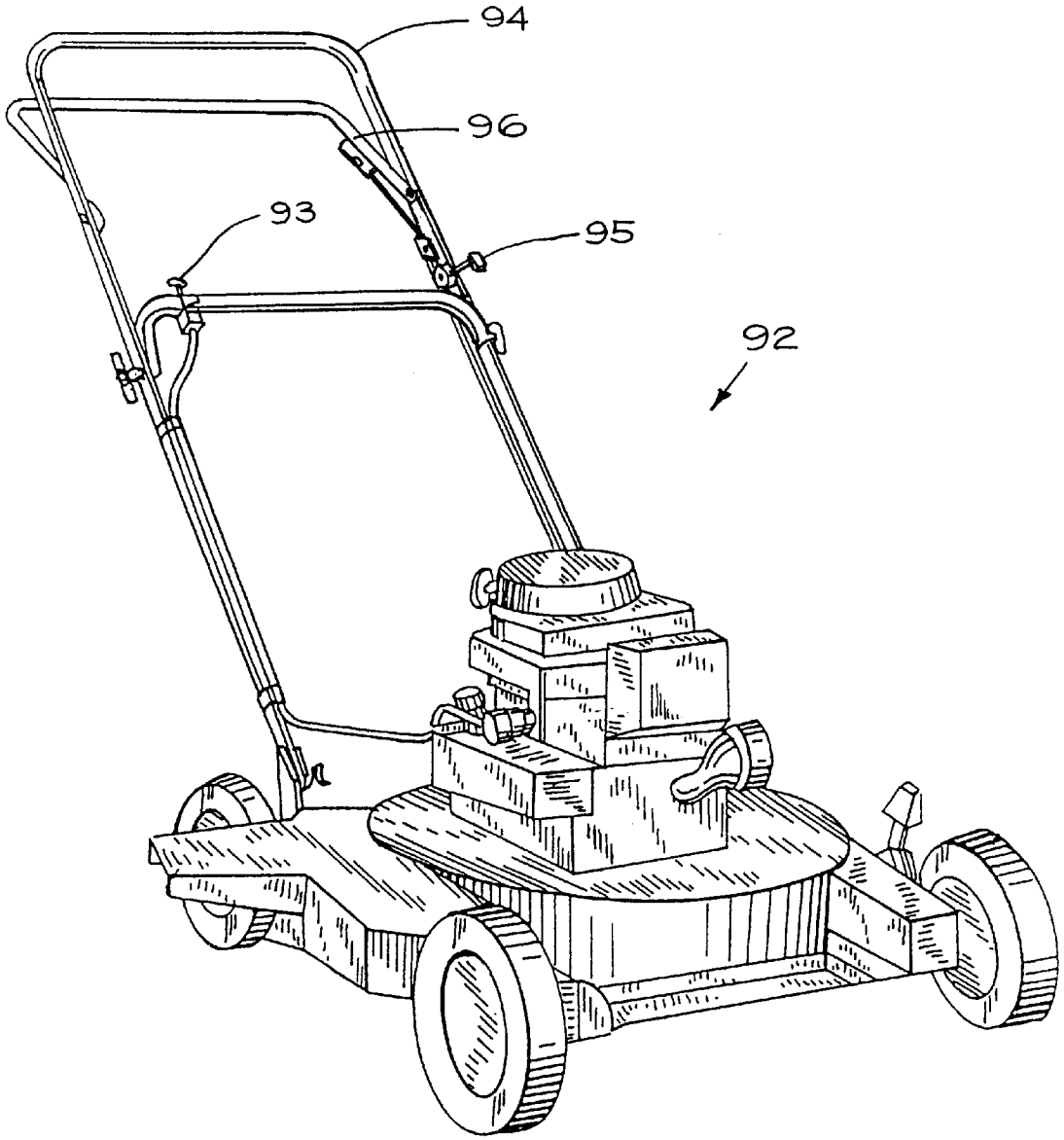
FIG. 1 is a perspective view of a lawn mower including an internal combustion engine incorporating one embodiment of the present invention.

FIGS. 1 through 18 illustrate a number of embodiments of the present invention. Each of the illustrated embodiments of the invention is used with an internal combustion engine having a carburetor and a combustion chamber. In FIGS. 2 and 3, engine 12 has a gas passageway 19 through which gas (the fuel/air mixture) may pass to an intake valve (not shown) of the engine 12. Carburetor 14 has a carburetor body 18 having a throat 20 extending therethrough, and a fuel bowl 22 secured to carburetor body 18 by a carburetor bowl mounting screw 23. Throat 20 has a throttle valve 28 and a choke valve 30 disposed therein. Throat 20 also has a reduced diameter portion or venturi 32 disposed therein, and one end which is interconnected with an intake manifold (not shown) in fluid flow communication with an intake valve (not shown). Gas passageway 19 includes throat 20 of carburetor 14 and the intake manifold (not shown). The intake valve (not shown) regulates the flow of air and fuel into a combustion chamber 16.

The illustrated embodiments (see FIG. 4) also include a fuel feed line 24 that acts as a passageway for fuel to flow from a fuel tank (not shown) to carburetor 14, and into fuel bowl 22. Carburetor 14 has a float 26 which floats on fuel in fuel bowl 22 and actuates a valve 27 which blocks fuel from flowing into the fuel bowl 22 when fuel bowl 22 is full. A fuel nozzle 34 extends from fuel bowl 22 to venturi 32, having one end 34*a* in fuel bowl 22, and another end 34*b* in venturi 32. Fuel nozzle 34 has multiple apertures for air 36 disposed in the side thereof The fuel nozzle 34 also includes at least one, and possibly more, fuel supply jets 35 that supply fuel to the end 34*a*. As will be described below, the fuel nozzle 34 acts as a high speed fuel circuit when fuel exits at end 34*b*. Fuel nozzle 34, throat 20, and the intake manifold (not shown) comprise a fuel conduit between fuel bowl 22 and the intake valve (not shown). When engine 12 is running, fuel flows from the fuel tank (not shown), through the fuel feed line 24, into the fuel bowl 22, up through at least a portion of the fuel nozzle 34, into the gas passageway 19, into the intake manifold (not shown), through the intake valve (not shown), and into combustion chamber 16.

Figure 5:
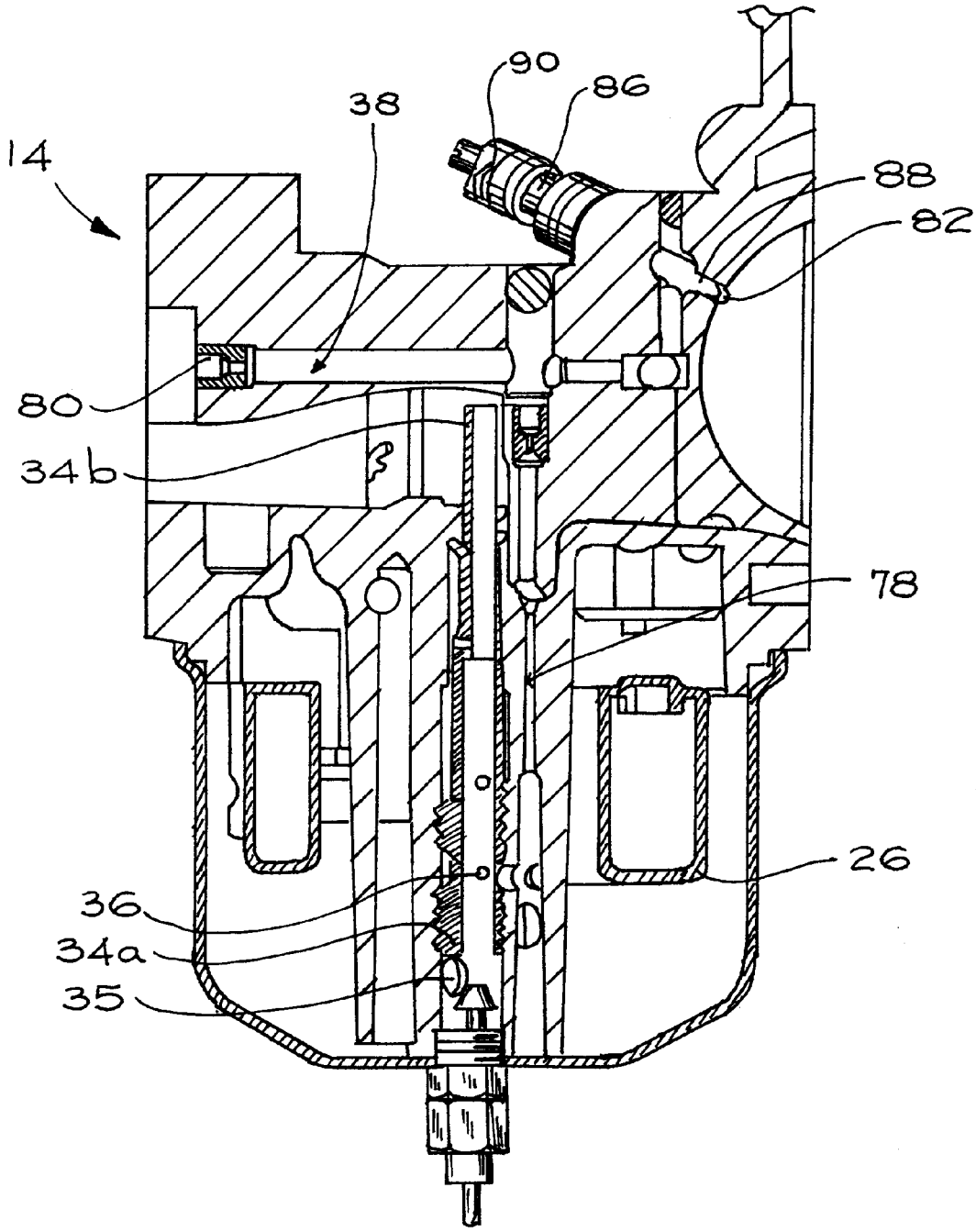
FIG. 5 is another cross sectional view of the carburetor in FIG. 3.

As best seen in FIG. 5, an air bleed circuit 38 is disposed in the carburetor body 18. The air bleed circuit 38 communicates with an idle and transition fuel circuit 78 adjacent the fuel nozzle 34. The idle and transition fuel circuit 78 also comprises part of the fuel conduit and communicates with the nozzle 34 at the bottom-most aperture 36. Fuel enters at nozzle end 34*a* and can get to the intake valve via the nozzle 34, the idle and transition fuel circuit 78 or a combination of both.

When the engine 12 is idling, the throttle valve 28 substantially blocks the throat 20. Atmospheric pressure air enters the air bleed circuit 38 through restrictor 80, flows through the air bleed circuit 38 due to the lower pressure created by the engine 12 and exits through the (see FIGS. 3 and 5) idle circuit aperture 82 in the passageway 19. As the air passes over the idle and transition circuit 78, fuel is drawn upward, via the commonly known venturi effect, into the idle and transition circuit 78 where it mixes with air flowing through the air bleed circuit 38 and exits through the idle aperture 82, which is on the engine side of the closed throttle valve 28.

When the throttle valve 28 begins to open for higher engine speed or the application of a load, transition apertures 84 (FIG. 3) are exposed. The transition apertures 84 also communicate with the idle and transition circuit 78. As the engine speed increases, the pressure differential in the air bleed circuit 38 increases, which draws the air through the air bleed circuit 38 faster, which in turn draws more fuel upward into the idle and transition circuit 78. The fuel exits through the idle aperture 82 and the transition apertures 84 to provide the increased amount of fuel necessary to accommodate the higher operational speed.

As the throttle valve 28 opens more, for even higher engine speeds, the pressure differential becomes great enough that air passes through the venturi 32, and over the nozzle end 34*b* in the direction of the arrow shown in FIG. 3. Fuel is now drawn upward through the nozzle 34 and eventually ceases to be drawn upward through the idle and transition circuit 78. When this occurs, the fuel passes only through the nozzle 34 and exits only at end 34*b*. This is referred to as the high speed fuel circuit. At one point, however, fuel is drawn up both the high speed fuel circuit and the idle and transition circuit 78.

Figure 4:
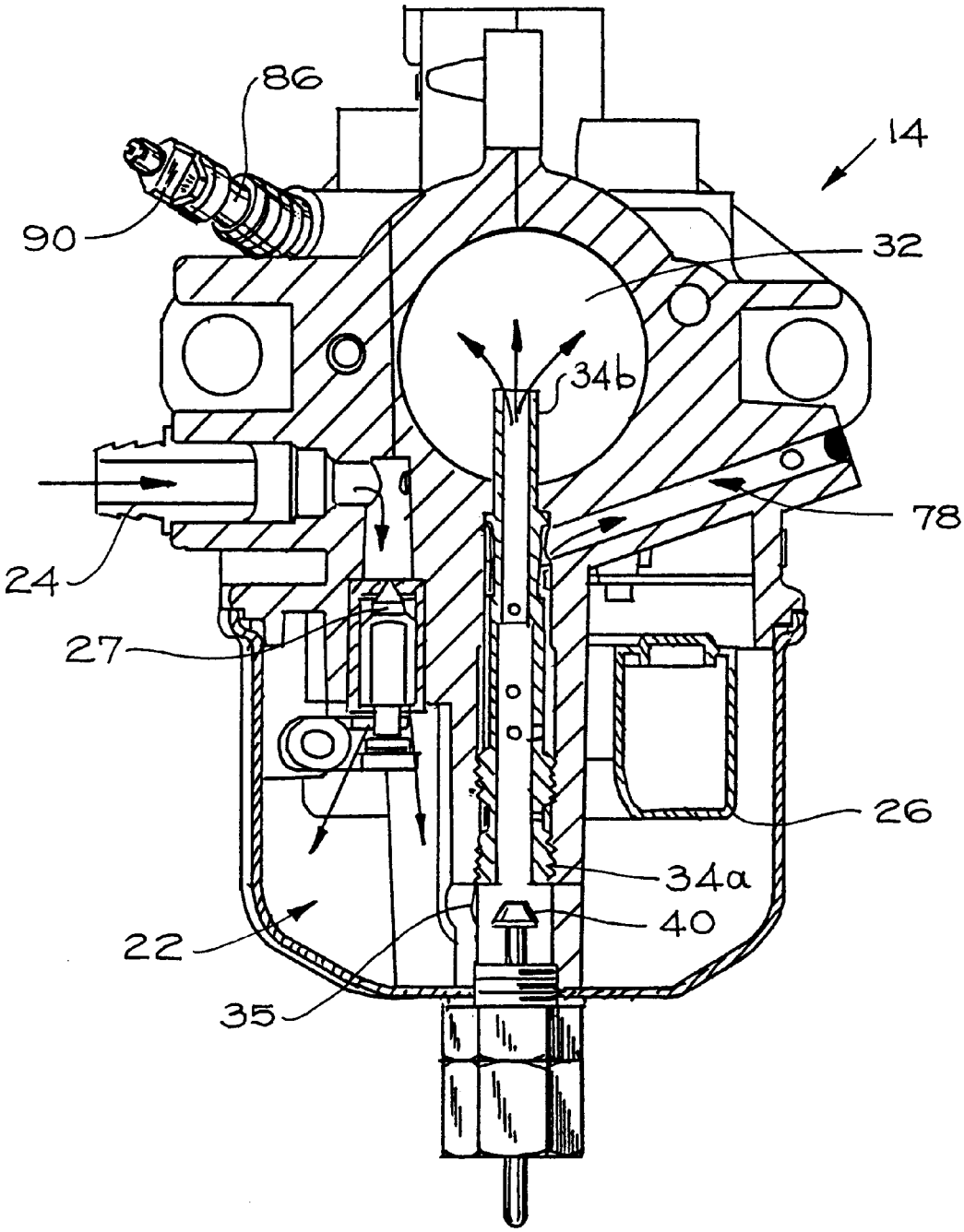
FIG. 4 is a cross sectional front view of the carburetor in FIG. 3.

The amount of fuel drawn into the idle and transition circuit 78 can be adjusted by a fuel metering device. As shown in FIGS. 4 and 5, the fuel metering device is an air adjustment screw 86 that adjusts the air flow through the air bleed circuit 38. The air adjustment screw 86 includes a needle end 88 that extends into the idle aperture 82. As the air adjustment screw 86 is manually turned, the needle end 88 can be inserted or retracted from inside the idle aperture 82. By changing the size of the idle aperture 82, the pressure differential in the air bleed circuit 38 is changed. This allows the manufacturer or user to adjust the amount of fuel drawn into the idle and transition circuit 78. As such, the air adjustment screw 86 acts as a fuel metering device for adjusting the air/fuel mixture. In the illustrated embodiment, the air adjustment screw 86 is capped with a limiter cap 90 that limits the adjustability of the screw 86. Limiter caps are commonly used due to governmental engine emissions standards.

Each of the illustrated embodiments in FIGS. 1 through 18, as described below, also includes a blocking member for selectively blocking the fuel conduit downstream of the fuel bowl to substantially prevent the passage of fuel to the intake valve. The blocking member is distinct from both the throttle valve 28 and the fuel metering device.

Figure 2:
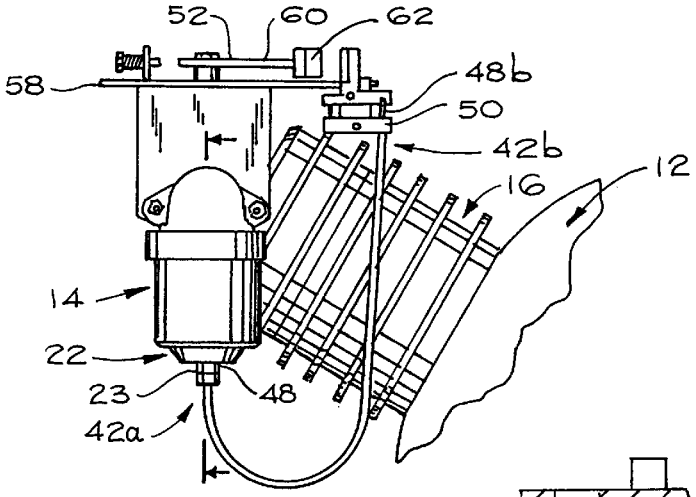
FIG. 2 is a partial side view of an internal combustion engine depicting a first embodiment of the present invention.
Figure 3A:
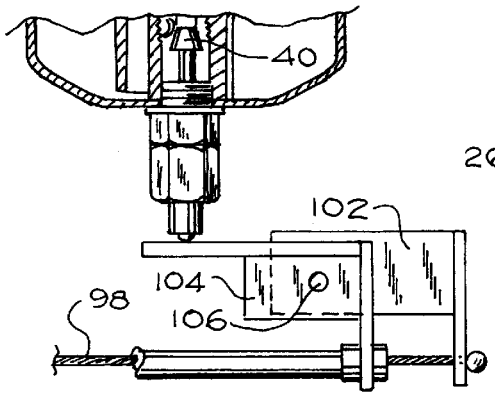
FIG. 3A is an enlarged partial view of FIG. 3.
Figure 3:
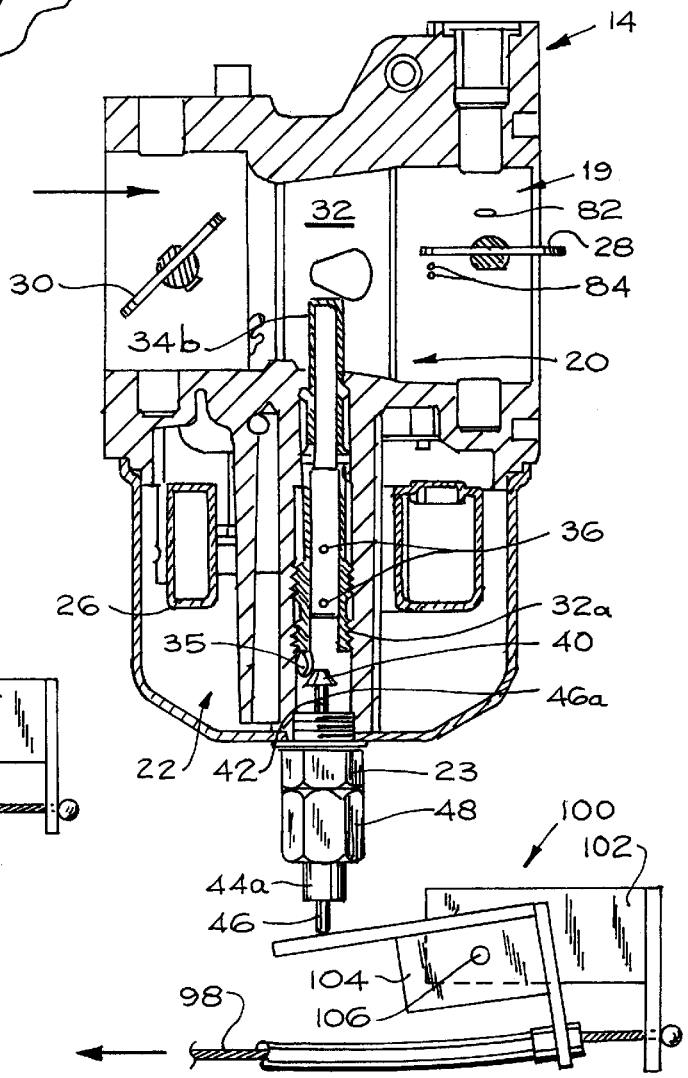
FIG. 3 is a cross sectional side view of a carburetor used in the first embodiment.
Figure 6:
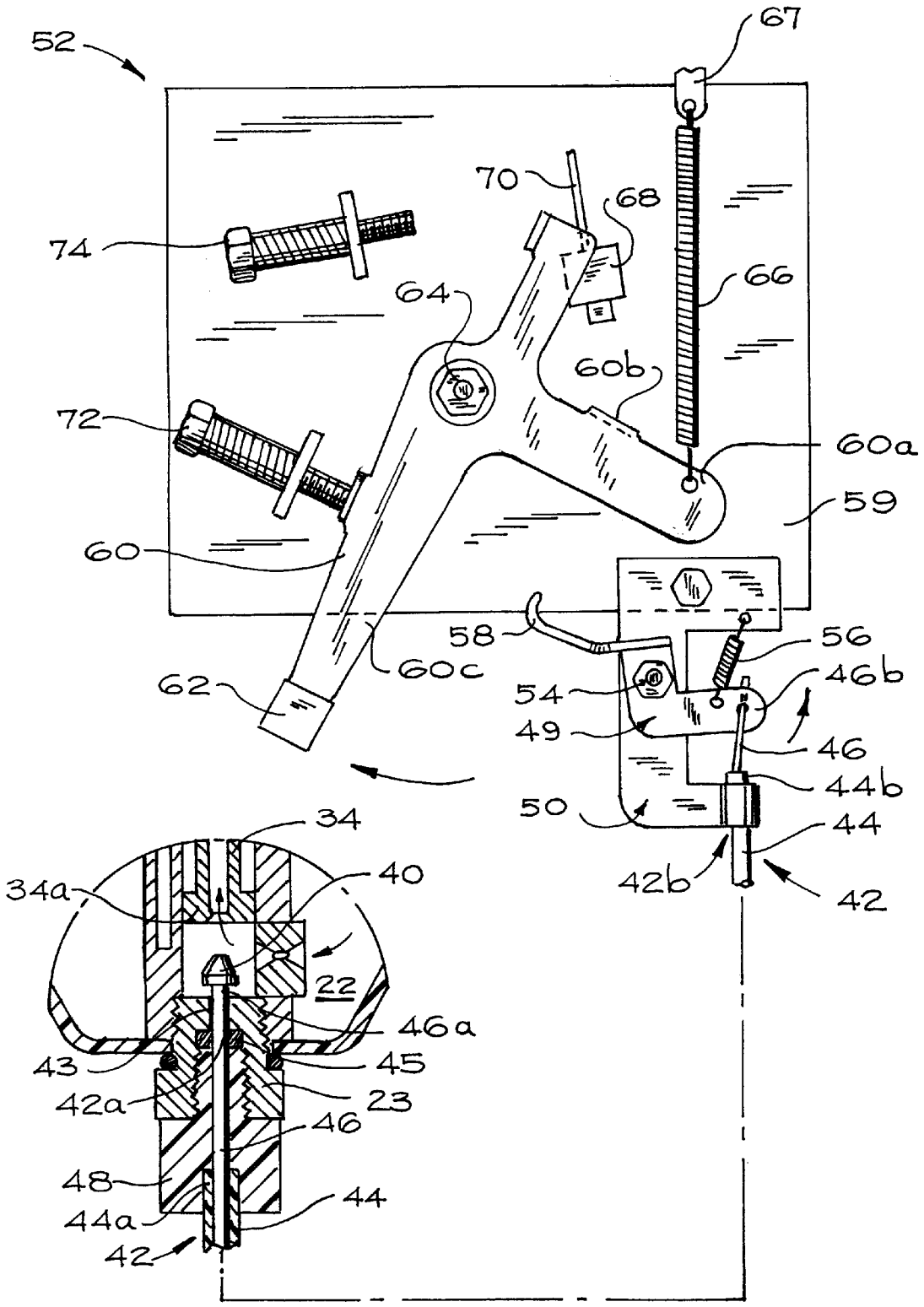
FIG. 6 is a schematic view of the first embodiment in the run position.
Figure 7:
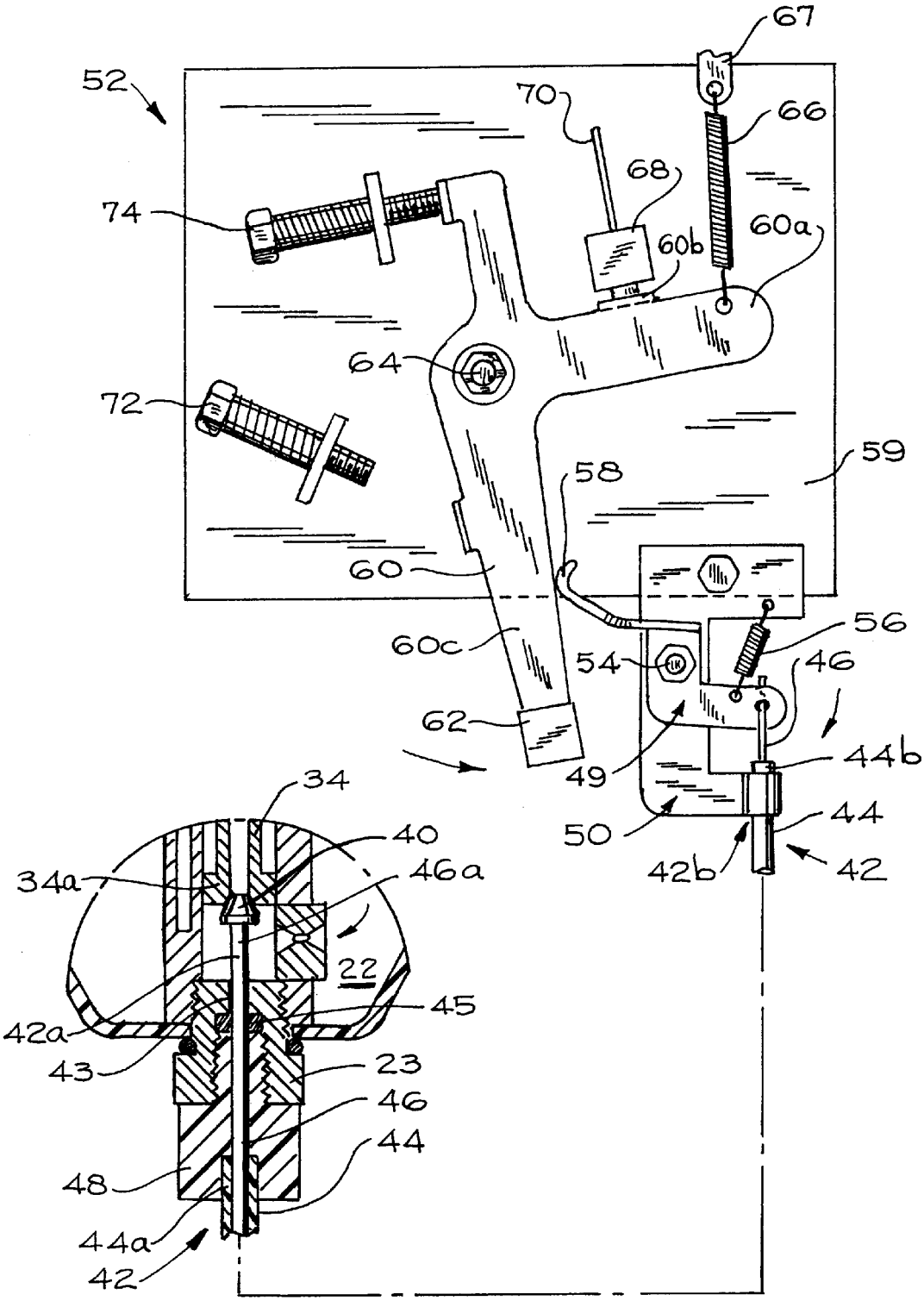
FIG. 7 is a schematic view of the first embodiment in the stop position.

FIGS. 1 through 7 illustrate a first embodiment of the present invention. Referring to FIGS. 2 through 7, a blocking member or plunger 40 is located in fuel bowl 22 adjacent to an input end 34*a* of fuel nozzle 34. Plunger 40 is selectively movable between a stop position in which plunger 40 blocks the flow of fuel into fuel nozzle 34, as shown in FIGS. 3A and 7, and a run position in which plunger 40 does not block the flow of fuel into fuel nozzle 34, as shown in FIGS. 3 and 6. Plunger 40 is preferably in the shape of a truncated cone for better sealing with the input end 34*a* of fuel nozzle 34. Additionally, plunger 40 is preferably made of material such as a metal, plastic or rubber that is insoluble in and impervious to fuel.

Although the blocking member has been depicted and described as a plunger blocking the input end of the fuel nozzle, it is apparent that the blocking member may have a different shape (eg. a plate, or sphere), and that it could be placed at the output end of the fuel nozzle or in a slot in the nozzle between the input and output ends.

As shown in FIGS. 2, 6 and 7, plunger 40 in the first embodiment is selectively movable between the stop or blocking position, and the run or non-blocking position through the use of a bowden cable 42 interconnected with a lever assembly 52. Bowden cable 42 has one end 42*a* attached to plunger 40 and extends from plunger 40 through an aperture 43 drilled through carburetor bowl mounting screw 23. Bowden cable 42 then extends to and has a second end 42*b* interconnected with an actuating lever assembly 52.

Plunger 40 is directly attached to one end 42*a* of bowden cable 42, and in one embodiment, plunger 40 and bowden cable 42 are at least partially made of metal, and bowden cable 42 is attached by soldering or other means to plunger 40. A tight seal is created between bowden cable 42 and carburetor bowl mounting screw 23, such that fuel cannot leak from fuel bowl 22 through aperture 43 in carburetor bowl mounting screw 23. An O-ring 45 or other similar means is used to create such a seal. In the first embodiment, the O-ring 45 may be supplied by National O-Ring, 11634 Patton Road, Downey, Calif. 90241.

Bowden cable 42 has an outer sheath 44 and an inner wire 46. Inner wire 46 is slightly longer than outer sheath 44, and is attached to plunger 40 on one end 46*a* and to an actuator lever 49 on the other end 46*b*. The outer sheath 44 surrounds the inner wire 46 and has an end 44*a* nearest the plunger 40 that is locked into position by a jam nut 48 which is attached to carburetor bowl mounting screw 23. The end 44*b* of the outer sheath 44 that is interconnected with the actuating lever assembly 52 is locked into position by a bowden cable clamp 50. One suitable bowden cable 42 is supplied by Capro Inc., 300 South Cochran, Willis, Tex. 77378.

As shown in FIGS. 6 and 7, the major components of actuating lever assembly 52 include actuator lever 49, a control lever 60, and a mounting plate 59.

In FIGS. 6 and 7, actuator lever 49 includes a first pivot 54, a return spring 56, and an engagement arm 58. First pivot 54 mounts actuator lever 49 to bowden cable clamp 50, which is in turn mounted to mounting plate 59. First pivot 54 allows actuator lever 49 to pivot between a run position as illustrated in FIG. 3, and a stop position as illustrated in FIG. 7. Because actuator lever 49 is interconnected with plunger 40 via bowden cable 42 when in the run position, actuator lever 49 pulls bowden cable 42 so that plunger 40 is in a non-blocking position. When in the stop position, actuator lever 49 pushes bowden cable 42 so that plunger 40 is in the blocking position.

Actuator lever 49 is moved between the run and the stop positions through the selective engagement of engagement arm 58 with control lever 60. Engagement arm 58 acts as a lever to pivot actuator lever 49 between the run and stop positions. Return spring 56 is interconnected between actuator lever 49 and bowden cable clamp 50, and returns actuator lever 49 to the run position when engagement arm 58 is not engaged with the control lever 60. In an alternate embodiment, actuator 49 may be spring biased to the closed or off position so that the engine may be transported without fuel spillage.

As shown in FIGS. 6 and 7, control lever 60 is preferably a rotary motion lever that has a handle or tab 62, and a second pivot 64. Of course, other types of levers may be used.

Second pivot 64 mounts control lever 60 to mounting plate 59 and allows for rotary motion of control lever 60 in relation to mounting plate 59. Control lever 60 has one portion 60*a* that is interconnected with a governor spring 66, another portion 60*b* which is selectively engageable with an ignition ground switch 68, and another portion 60*c* that is selectively engageable with engagement arm 58.

Governor spring 66 is interconnected between a governor arm 67 and control lever 60 and acts to adjust the speed of engine 12 (FIG. 2) as control lever 60 is rotated. As control lever 60 is rotated in a clockwise direction, as illustrated in FIG. 3, governor spring 66 is tightened, throttle valve 28 (FIG. 3) is moved to a more open position, and the engine runs faster. As control lever 60 is rotated in a counter-clockwise direction, as illustrated in FIG. 7, governor spring 66 is loosened, throttle valve 28 (FIG. 3) is moved to a more closed position, and the engine runs slower. Therefore, control lever 60 is a manually-operable control that controls both the throttle valve 28 and the blocking member or plunger 40.

In fixed speed applications, such as generators and the like, the throttle position is often not manually-controllable. In these applications, control lever 60 would only control the blocking member, and governor spring 66 would not be interconnected with control lever 60.

Ignition ground switch 68 is interconnected with an ignition wire 70, and selectively grounds the ignition system (not shown) of engine 12 (FIG. 2) to stop the engine. The fuel shutoff system of the present invention should stop the engine without the ignition ground switch. When control lever 60 engages ignition ground switch 68, ignition ground switch 68 grounds the ignition system, and the engine stops. In the preferred embodiment, the ignition ground switch 68 may be supplied by Fastex Division, 195 Algonquin Road, Des Plaines, Ill. 60016.

Control lever 60 only engages ignition ground switch 68 and engagement arm 58 when it is in the fully counter-clockwise position illustrated in FIG. 7. Therefore, the ignition system is grounded and plunger 40 is moved to the blocking position only when control lever 60 is in the fully counter-clockwise position. Plunger 40 is fully closed and ignition ground switch 68 are actuated at substantially the same time by control lever 60.

Referring again to FIGS. 6 and 7, two adjustable stops 72 and 74 are on mounting plate 59, and limit the rotary motion of control lever 60. First stop 72 stops the control lever 60 in an engine run position, as illustrated in FIG. 3. Second stop 74 stops control lever 60 in an engine stop position, as illustrated in FIG. 7.

FIG. 1 illustrates a remotely operated version of the first embodiment in combination with a lawn mower 92. The lawn mower 92 includes a handle 94 having a remote primer 93, which is pushed to inject raw fuel into the carburetor throat 20 prior to starting, a throttle lever 95, which opens and closes the throttle valve 28 to affect engine speed, and a deadman lever or switch 96 as is commonly known. The deadman switch 96 is coupled to the actuator lever assembly 100 illustrated in FIGS. 3 and 3A. A bowden cable 98 preferably couples the deadman switch 96 to the actuator assembly 100, however other methods of coupling may be employed. Actuator assembly 100 includes a fixed member 102, fixed to the engine 12, and a movable member 104, movable relative to fixed member 102. Preferably, the movable member 104 pivots about pivot point 106 to actuate the plunger 40 either by pulling it down to the run position, or by pushing it up to the stop position. When the deadman lever 96 is held in the run position, the bowden cable 98 is taut. The sheath of the bowden cable 98 is fixed to the movable member 104 causing the actuator lever assembly 100 to be in the run position as shown in FIG. 3. When the deadman switch 96 is released, the bowden cable 98 slacks inside the sheath and the actuator lever 100 pivots to the stop position in FIG. 3A. Bowden cable 98 can also be interconnected to an ignition grounding switch (not shown), but this need not be the case.

Variations of the remotely operated embodiment shown in FIG. 1 can also be utilized with generators, pumps, snow blowers and the like. In the case of generators for example, the engine controls are often remotely located from the engine on a frame. The fuel shutoff device can also be remotely actuated using a push/pull knob, as described below with respect to FIG. 10, or any other suitable actuation device.

Figure 8:
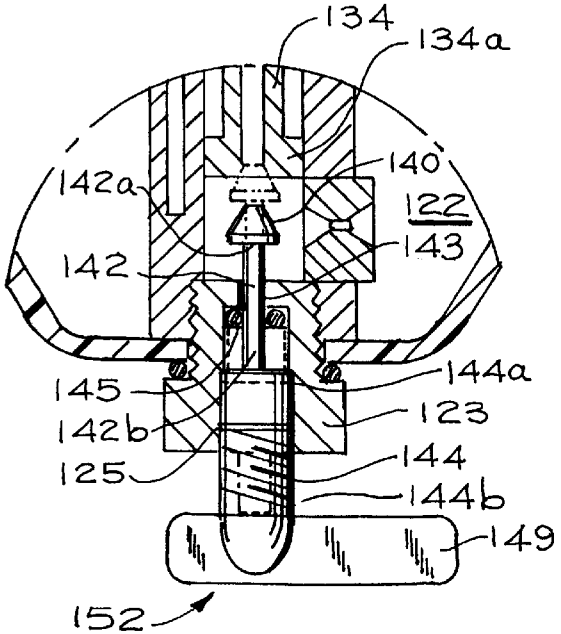
FIG. 8 is a partial side view of a blocking member used in a second embodiment of the invention, shown in partial section, depicting a rotatable lever arm interconnected with the blocking member.

FIG. 8 illustrates a blocking member or plunger 140 and a mechanical actuating means used in a second embodiment of the invention. As in the first embodiment, plunger 140 is located in a fuel bowl 122 adjacent to an intake end 134*a* of a fuel nozzle 134. Plunger 140 is selectively movable between a first, stop position in which plunger 140 blocks the flow of fuel into fuel nozzle 134 (shown in phantom in FIG. 8), and a second, run position in which plunger 140 does not block the flow of fuel into fuel nozzle 134 (shown by the solid lines in FIG. 8).

Although blocking member 140 has been depicted and described as a plunger 140 blocking input end 134*a* of fuel nozzle 134, it is apparent that blocking member 140 may have a different shape (eg. a plate), and that it could be placed at the output end 134*b* (FIG. 8) of fuel nozzle 134 or in a slot in the fuel nozzle between input end 134*a* and output end 134*b* (FIG. 8).

Plunger 140 in FIG. 8 is selectively movable between the stop or blocking position, and the run or non-blocking position through the use of a connecting member 142 interconnected with a rotating actuating lever assembly 152. Connecting member 142 has one end 142*a* attached to plunger 140, and extends from plunger 140 through an aperture 143 drilled through the center of the carburetor bowl mounting screw 123. Connecting member 142 then extends to and has a second end 142*b* interconnected with a rotating actuating lever assembly 152.

A tight seal is created between connecting member 142 and carburetor bowl mounting screw 123, such that fuel cannot leak from fuel bowl 122 through aperture 143. As in the first embodiment, an O-ring 145 or other similar means is used to create such a seal.

Carburetor bowl mounting screw 123 has an internally threaded bore 125 therein, and the actuating lever assembly 152 includes a threaded member 144 which is threaded into threaded bore 125. One end 144*a* of threaded member 144 is connected to connecting member 142, and the other end 144*b* of threaded member 144 is connected to a lever arm 149. When lever arm 149 is rotated such that the pitch of the thread in threaded bore 125 advances threaded member 144 further into threaded bore 125, plunger 140 is advanced towards the intake end 134*a* of fuel nozzle 134 via connecting member 142. When plunger 140 contacts or substantially contacts the intake end 134*a* of fuel nozzle 134, plunger 140 blocks or substantially blocks the flow of fuel into fuel nozzle 134, and is therefore in the stop or blocking position.

As lever 149 arm is rotated such that the pitch of the thread in threaded bore 125 moves threaded member 144 further out of threaded bore 125, plunger 140 is moved away from intake end 134*a* of fuel nozzle 134 via connecting member 142. When plunger 140 is not in contact or substantial contact with intake end 134*a* of fuel nozzle 134, plunger 140 does not block or substantially block fuel from flowing into fuel nozzle 34, and is therefore in the run or non-blocking position.

Figure 9:
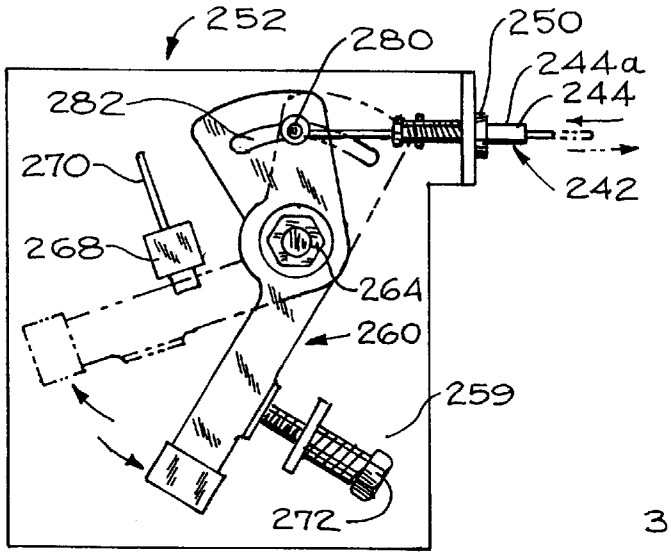
FIG. 9 is a schematic view of a control lever used in a third embodiment of the invention, depicting a bowden wire directly connected to the control lever.

FIG. 9 illustrates an actuating lever assembly 252 used in a third embodiment of the invention. In the actuating lever assembly 252 of the third embodiment, a bowden cable 242 is directly attached to a rotary motion control lever 260 via an adjustment bolt 280. Adjustment bolt 280 is attached to control lever 260 at an elongated opening or adjustment slot 282 in the control lever 260. For calibration of the embodiment, the attachment point of bowden cable 242 to control lever 260 can be adjusted by repositioning adjustment bolt 280 in adjustment slot 282. By repositioning the attachment point of bowden cable 242 to control lever 260, the movement of bowden cable 242 in relation to the movement of control lever 260 is adjusted. Additionally, the end 244*a* of an outer sheath 244 of bowden cable 242 is held in position by a second jam nut 250 which is connected to the mounting plate 259, rather than by a bowden cable clamp 50 (FIGS. 6 and 7) as in the first embodiment.

The actuating lever assembly 252 in the third embodiment also includes an ignition ground switch 268 interconnected with an ignition wire 270, an adjustable stop 272, and a second pivot 264, which are similar to the corresponding components discussed above in the first embodiment.

Figure 10:
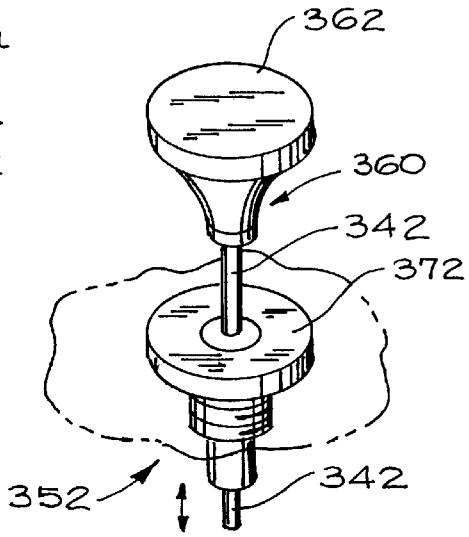
FIG. 10 is a perspective view of a push pull motion type lever-bowden cable assembly of a fourth embodiment of the invention.

FIG. 10 illustrates yet another actuating lever assembly 352 used in a fourth embodiment of the invention. In the fourth embodiment, actuating lever assembly 352 includes a remote control lever 360 which is a push/pull motion type lever. Control lever 360 includes a push/pull knob 362, a connecting member 342, and a stop 372. Connecting member 342 may be connected to a bowden cable 342, which in turn is interconnected with the blocking member 40 (FIGS. 3 and 7), or connecting member 342 may be connected directly to blocking member 40 (FIGS. 3 and 7). When the push/pull knob 360 is pulled out in relation to the stop 372, blocking member 40 (FIGS. 3 and 7) is positioned such that it does not block the fuel flow in the fuel conduit, and the embodiment is in the run or non-blocking position. When the push/pull knob 362 is pushed-in in relation to the stop 372, blocking member 40 (FIGS. 3 and 7) is positioned such that it blocks the fuel flow in the fuel conduit, and the embodiment is in the stop or fuel blocking position.

In the fourth embodiment, an ignition ground switch 68 (FIGS. 2 and 6) is also interconnected with the actuating lever assembly 352. The ignition ground switch 68 (FIGS. 2 and 6) may be interconnected with the actuating lever assembly 352 via bowden cable 342, or may be directly attached to actuating lever assembly 352. When the push/pull knob 360 is pushed-in to the stop position, the ignition ground switch 68 (FIGS. 2 and 6) is actuated, and grounds the ignition system of the engine.

Figure 11:
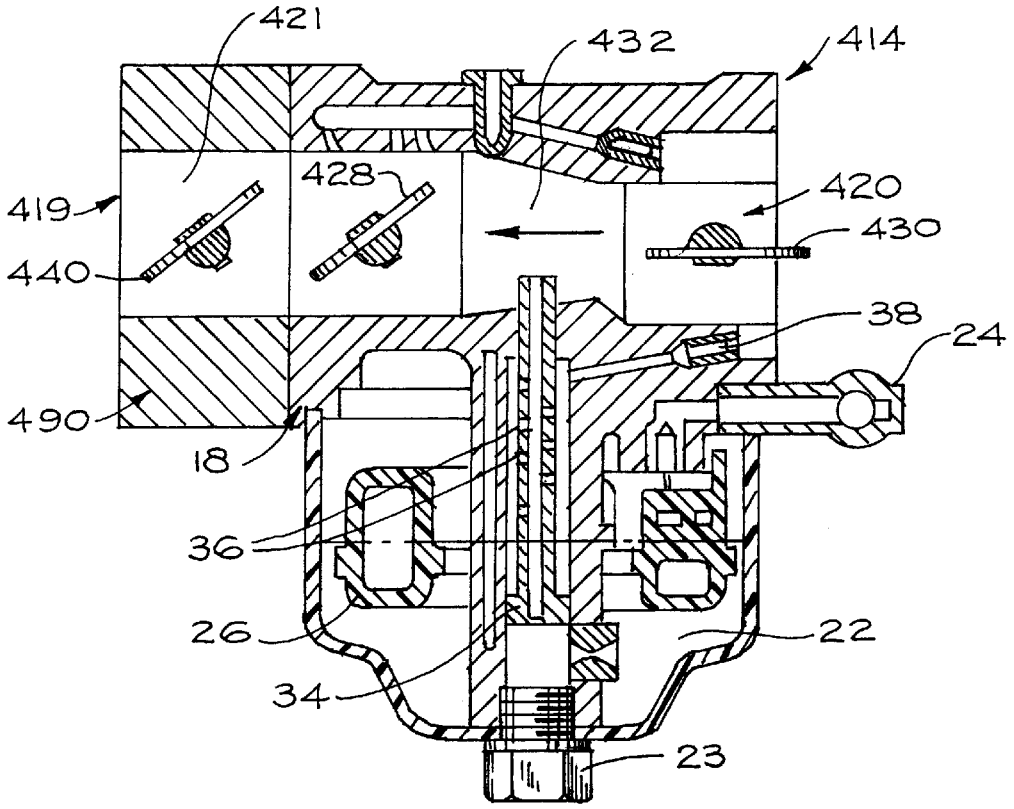
FIG. 11 is a cross sectional side view of a carburetor according to a fifth embodiment of the invention, depicting a blocking member in the gas passageway.

FIGS. 11 through 13A depict a fifth embodiment of the present invention. As best shown in FIG. 11, a blocking member or fuel/air mixture blocking valve 440 is disposed in a gas passageway 419 of the engine 12 (FIG. 2). A throttle valve 428 and a choke valve 430 are also disposed in the gas passageway 419, and are distinct from blocking member 440. Air flows through the gas passageway 419 in the direction of the arrows in FIGS. 11, 12A and 13A. In FIG. 11, a spacer block 490 is located between the carburetor 414 and the intake manifold (not shown). Spacer block 490 has a hollow bore 421 therethrough, and is positioned such that hollow bore 421 is included in gas passageway 419. Carburetor throat 420, having a venturi 432, is also part of the gas passageway 419. Fuel blocking valve 440 is disposed within hollow bore 421 of spacer block 490.

Figure 12A:
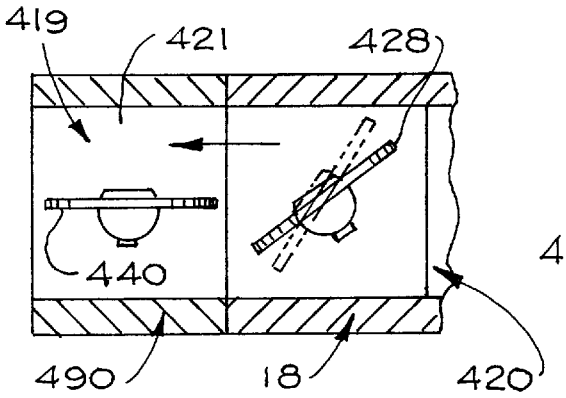
FIG. 12A is an exploded side view of the blocking member according to the fifth embodiment, depicted in the run position.
Figure 13A:
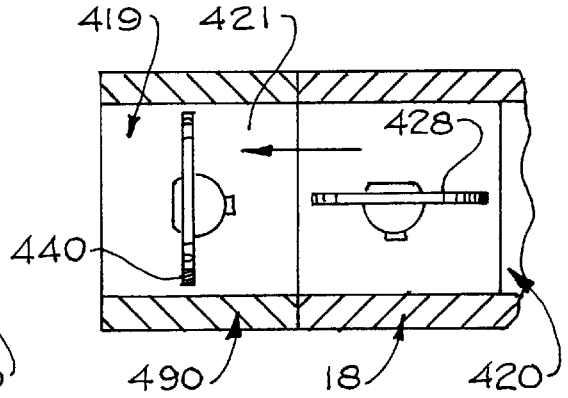
FIG. 13A is an exploded side view of the blocking member according to the fifth embodiment, depicted in the shutoff position.

Fuel blocking valve 440 is selectively movable between a first, stop position in which blocking valve 440 blocks the flow of the air/fuel mixture in gas passageway 419, as illustrated in FIG. 13A, and a second, run position in which blocking valve 440 does not block the flow of the air/fuel mixture in gas passageway 419 as illustrated in FIG. 12A. Fuel blocking valve 440 is preferably in the form of a butterfly valve, and is sized such that when in a blocking position, fuel blocking valve 440 blocks, or substantially blocks, the flow of the air/fuel mixture through gas passageway 419. (FIG. 13A).

Figure 12:
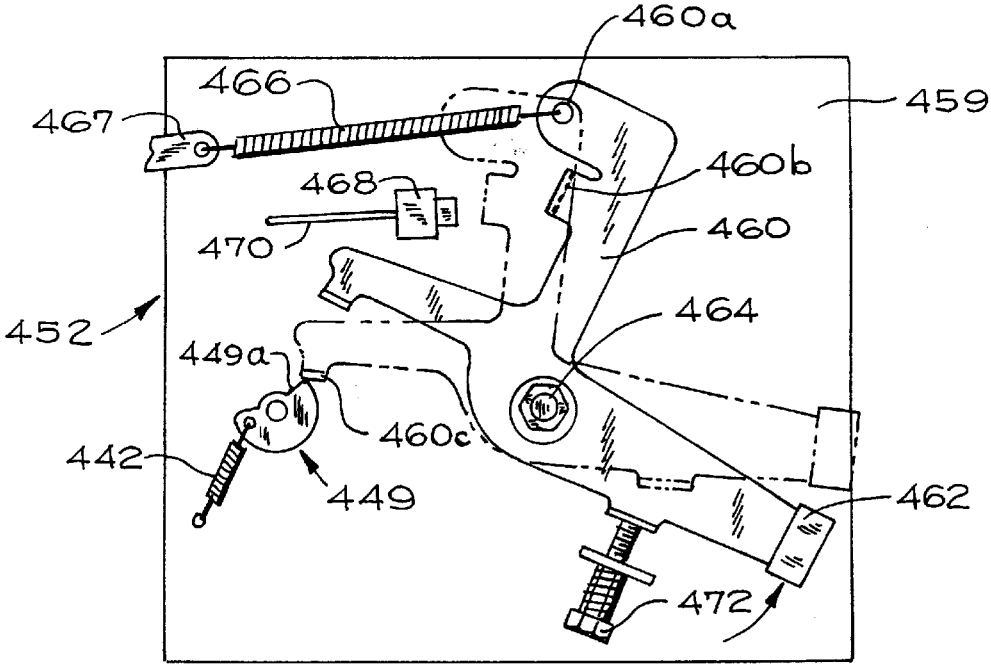
FIG. 12 is a schematic view of a control lever of the fifth embodiment, in the run position.
Figure 13:
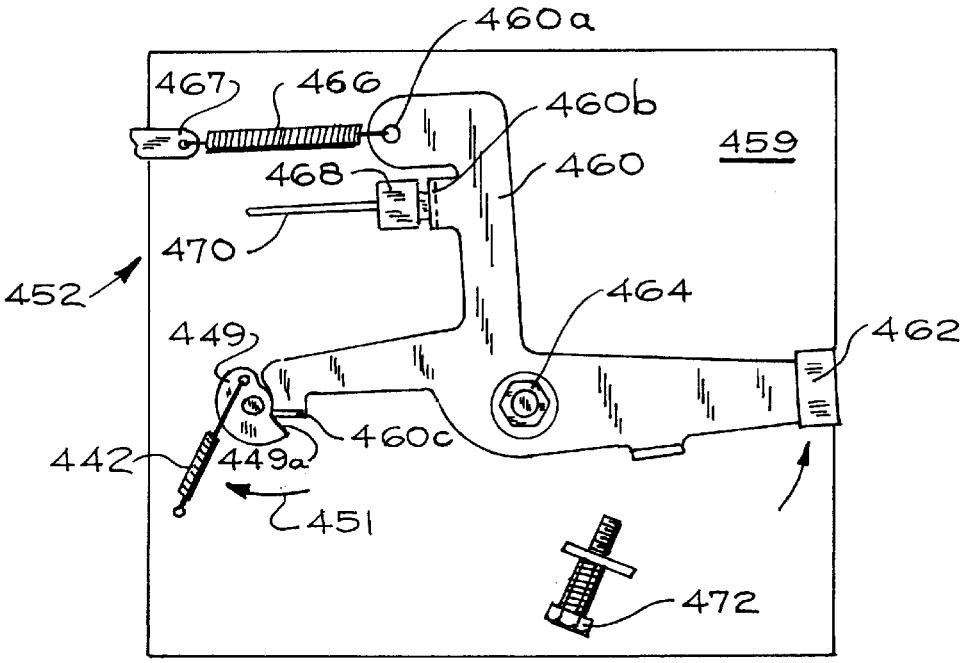
FIG. 13 is a schematic view of the control lever of the fifth embodiment of the invention, in the shutoff position.

Fuel blocking valve 440 in the fifth embodiment is selectively movable between the blocking position and the non-blocking position through the use of an actuating lever assembly 452 interconnected with fuel blocking valve 440. Referring to FIGS. 12 and 13, the major components of actuating lever assembly 452 include a control lever 460, an actuator cam 449, a cam spring 442 and a mounting plate 459.

As depicted in FIGS. 12 and 13, control lever 460 is a rotary motion lever that has a handle or tab 462, and a second pivot 464. Of course, other types of levers may be used. Control lever 460 has one portion 460*a* that is interconnected with a governor spring 466, another portion 460*b* which is selectively engageable with an ignition ground switch 468, and another portion 460*c* that is selectively engageable with actuator cam 449. As control lever 460 is rotated so as to engage actuator cam 449, actuator cam 449 is rotated in a clockwise direction, as shown by arrow 451.

In the fifth embodiment, there is a direct mechanical link between actuator cam 449 (FIGS. 12 and 13) and fuel blocking valve 440 (FIGS. 12A and 13A). The link may be a shaft, a rack and pinion apparatus, or gears, as is well known in the trade. Other embodiments of the invention may link actuator cam 449 and fuel blocking valve 440 through the use of a bowden cable, or other similar means.

As actuator cam 449 is rotated in a clockwise direction through engagement with control lever 460, fuel blocking valve 440 is moved from a non-blocking to a blocking position via the direct mechanical link between fuel blocking valve 440 and actuator cam 449. The use of actuator cam 449 allows for efficient switching of fuel blocking valve 440 between the blocking and non-blocking positions. Due to the profile of cam surface 449*a* of the actuator cam 449, once speed control lever 460 engages actuator cam 449, a small amount of angular movement of control lever 460 results in a large amount of angular movement of fuel blocking valve 440, thereby reducing the amount of control lever movement needed to actuate fuel blocking valve 440 into a blocking position. By comparing FIGS. 12 through 13A, it is apparent that a rotation of cam 449 of less than 45 degrees from the open position (FIG. 12) to the closed position (FIG. 13) results in a 90 degree rotation of fuel blocking valve 440 from the open position (FIG. 12A) to the closed position (FIG. 13A). Fuel blocking valve 440 is spring loaded so that fuel blocking valve 440 remains in the fully open or non-blocking position when control lever 460 is not engaging actuator cam 449.

Ignition ground switch 468 in the fifth embodiment is similar to ignition ground switch 68 (FIGS. 6 and 7) discussed above in the first embodiment. Additionally, the structure relating to the governor spring 466 and its attachment between governor spring 467 and control lever 460 in the fifth embodiment is substantially the same as in the first embodiment discussed above. As in the first embodiment, the governor spring is not attached to control lever 460 in most fixed speed applications.

The operation of the fifth illustrated embodiment of the invention is best shown by comparing FIGS. 12 and 12A with FIGS. 13 and 13A. FIG. 12 and 12A, in combination, illustrate the fifth embodiment of the invention in the run, non-blocking and non-grounding position. Control lever 460 is in a position such that it does not engage actuator cam 449. In this position, actuator cam 449 is held in a run position by cam spring 442. Fuel blocking valve 440 remains in a non-blocking position, thereby allowing the air/fuel mixture to flow through gas passageway 419 and to the intake valve. In this position, control lever 460 does not engage ignition ground switch 468, so the ignition system of the engine is not grounded. Additionally, governor spring 466 is pulled, thereby moving throttle valve 28 into a more open position, making the engine 12 run faster.

The phantom lines in FIGS. 12 and 12A illustrate the fifth embodiment in a slow run position, with throttle valve 28 partially closed, fuel blocking valve 440 in a non-blocking position, and ignition ground switch 468 and actuator cam 449 not actuated by control lever 460. The solid lines in FIGS. 12 and 12A illustrate the fifth embodiment in the fast run position, with control lever 460 engaging stop 472, throttle valve 428 more open, fuel blocking valve 440 in a non-blocking position, and ignition ground switch 468 and actuator cam 449 not actuated by control lever 460.

FIGS. 13 and 13A illustrates the fifth embodiment of the invention in the stop, blocking and grounding position. Control lever 460 is rotated as far counter-clockwise as possible so that control lever 460 engages actuator cam 449. In this position, control lever 460 engages actuator cam 449 such that fuel blocking valve 440 is rotated to the blocking position, thereby substantially blocking the air/fuel mixture from flowing through gas passageway 419 into the intake valve. Control lever 460 engages ignition ground switch 468, so that the ignition system of the engine is grounded. Additionally, governor spring 466 is loosened thereby moving throttle valve 428 into a fully open position.

Control lever 460 only engages ignition ground switch 468 and actuator cam 449 when it is in or substantially close to the fully counter-clockwise position illustrated in FIG. 13. Therefore, ignition ground switch 468 is actuated and fuel blocking valve 440 is in the blocking position only when control lever 460 is in the fully counter-clockwise position. Actuator cam 449, and therefore fuel blocking valve 440 as well as ignition ground switch 468, are actuated at substantially the same time by control lever 460.

Figure 15:
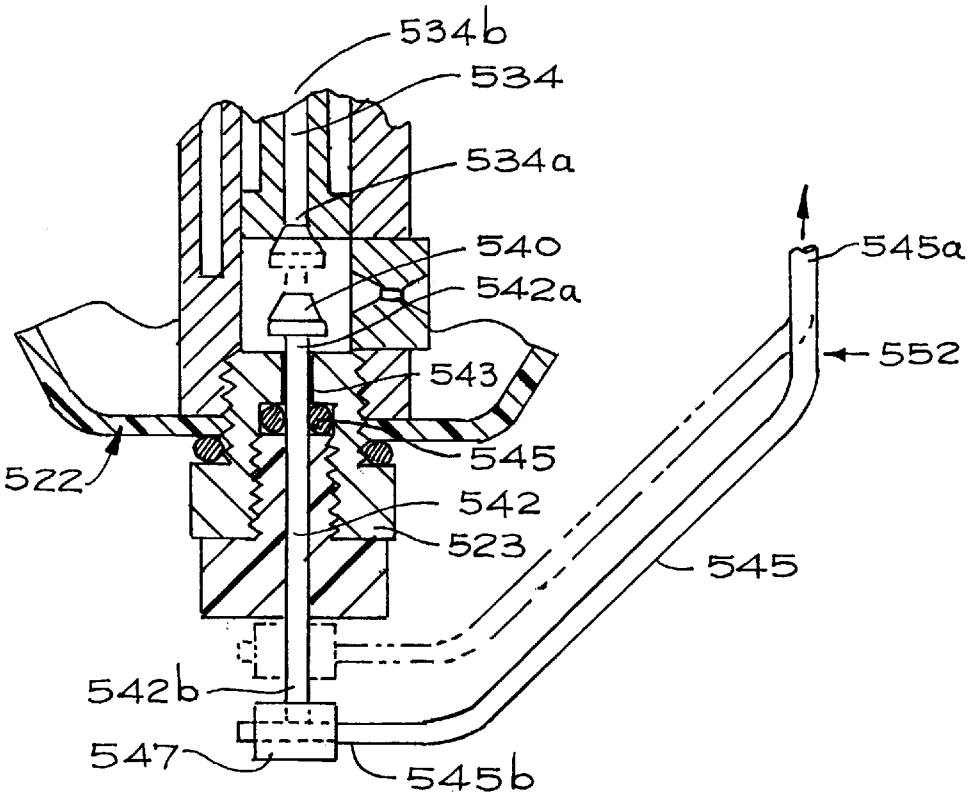
FIG. 15 is a partial cross-sectional view of a carburetor used in the sixth embodiment of the invention.

FIGS. 14 through 18 illustrate a mechanical actuating means used in a sixth embodiment of the invention using a link arm lever assembly 552. As shown in FIG. 15, plunger 540 is located in a fuel bowl 522 adjacent to an intake end 534*a* of a fuel nozzle 534. Plunger 540 is selectively movable between a first, stop position in which plunger 540 blocks the flow of fuel into fuel nozzle 534 (shown in phantom in FIG. 15), and a second, run position in which plunger 540 does not block the flow of fuel into fuel nozzle 534 (shown by the solid lines in FIG. 15).

Although blocking member 540 has been depicted and described as a plunger 540 blocking input end 534*a* of fuel nozzle 534, it is apparent that blocking member 540 may have a different shape (eg. a plate), and that it could be placed at the output end 534*b* of fuel nozzle 534 or in a slot in the fuel nozzle between input end 534*a* and output end 534*b*.

Plunger 540, as shown in FIG. 15, is selectively movable between the stop or blocking position, and the run or non-blocking position through the use of a connecting member 542 interconnected with a link arm lever assembly 552. Connecting member 542 has one end 542*a* attached to plunger 540, and extends from plunger 540 through an aperture 543 drilled through the center of the carburetor bowl mounting screw 523. Connecting member 542 then extends to and has a second end 542*b* interconnected with the link arm lever assembly 552.

A tight seal is created between connecting member 542 and carburetor bowl mounting screw 523, such that fuel cannot leak from fuel bowl 522 through aperture 543. As in the first embodiment, an O-ring 595 or other similar means is used to create such a seal.

The link arm lever assembly 552 includes a generally L-shaped link arm 545 having a first end 545*a* and a second end 545*b*. The second end of link arm 545*b* is interconnected with the second end of connecting member 542*b*. As shown in FIG. 12, the second end of link arm 545*b* and the second end connecting member 542*b* are interconnected by an interconnecting member 547. In the alternative, the link arm 545 and the connecting member 542 can be interconnected by other interconnecting means known in the art, such as welding, or may be integrated together into a single part.

Figure 14:
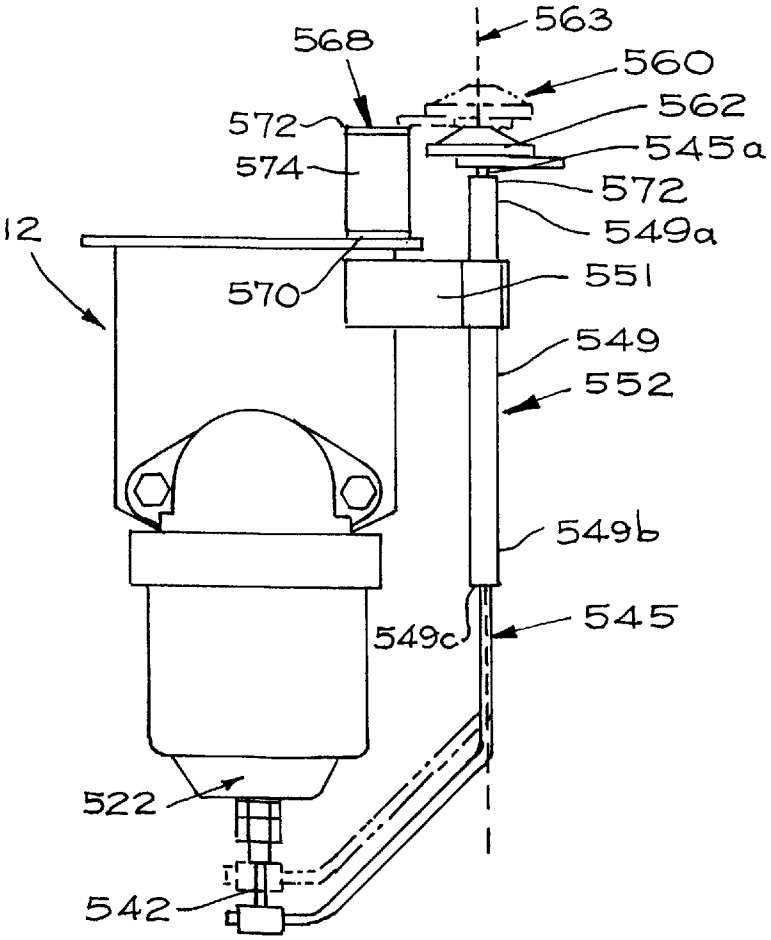
FIG. 14 is a partial side view of an internal combustion engine depicting a sixth embodiment of the present invention.

As shown in FIG. 14, a guide member 549 is attached to engine 12 by guide member retainer bracket 551. Guide member 549 is an elongated tube having an elongated bore 549*c* extending therethrough about axis 563. Guide member 549 has a first end 549*a* and a second end 549*b*. Link arm 545 extends through and is slidably engaged with bore 549*c* from second end 549*b* to first end 549*a* about axis 563.

Figure 17:
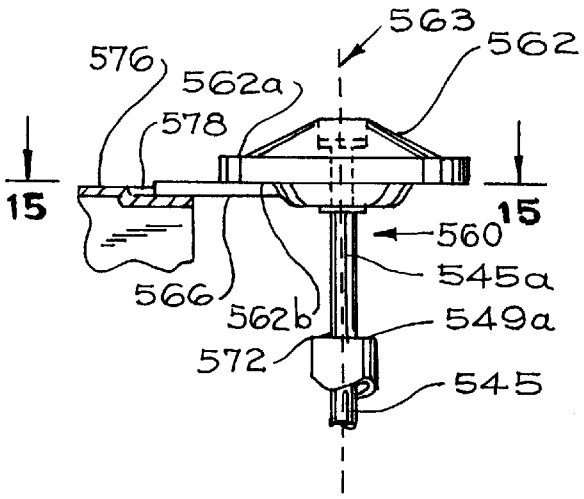
FIG. 17 is a side view of the push/pull motion type lever-link arm assembly used in the sixth embodiment of the invention.

The first end of link arm 545*a* extends from the first end of guide member 549*a* and is interconnected with a push/pull motion type lever 560. The lever 560 includes a push/pull motion knob 562, and a stop 572. Referring to FIG. 17, knob 562 is rotatably mounted on first end 545*a* such that knob 562 can generally rotate about axis 563. Knob 562 is a generally disc shaped member having a top edge 562*a* and a bottom edge 562*b*. A locking member 566 is mounted to the bottom edge 562*b*, and extends horizontally therefrom.

As shown in FIG. 17, the first end of guide member 549*a* acts as the stop 572 for lever 560. In other embodiments, a separate stop member can be employed.

Figure 18:
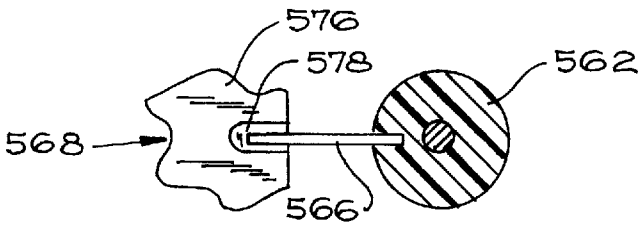
FIG. 18 is a top cross-sectional view of the push/pull knob, taken along line 18—18 in FIG. 17.

Referring to FIG. 14, a locking bracket 568 is mounted to the engine 12 substantially adjacent to knob 562. Bracket 568 is a generally C-shaped member having a first arm 570, a second arm 572 and a web 574 interconnecting arms 570 and 572 respectively. First arm 570 is attached to the engine 12. Second arm 572 has a top surface 576 having a recess 578 therein as shown in FIGS. 17 and 18.

As shown in phantom in FIGS. 14 and 15, as the push/pull knob 562 is pulled out in relation to the stop 572, plunger 540 is advanced towards the intake end 534*a* of fuel nozzle 534 via link arm 545 and connecting member 542. When plunger 540 contacts or substantially contacts the intake end 534*a* of fuel nozzle 534, plunger 540 blocks or substantially blocks the flow of fuel into fuel nozzle 534, and is therefore in the stop or blocking position. As shown in FIGS. 17 and 18, and as shown in phantom if FIG. 14, the knob 562 can then rotated about axis 563 such that locking member 566 is engaged with locking bracket 568 and fits within recess 578. In this position, the plunger 540 is held substantially in the stop position.

To unlock the locking member, the knob is rotated such that locking member 566 does not engage the locking bracket 568. As shown in FIGS. 14 and 15, as the push/pull knob 562 is pushed-in in relation to the stop 572, plunger 540 is moved away from intake end 534*a* of fuel nozzle 534 via link arm 545 and connecting member 542. When plunger 540 is not in contact or in substantial contact with intake end 534*a* of fuel nozzle 534, plunger 540 does not block or substantially block fuel from flowing into fuel nozzle 534, and is therefore in the run or non-blocking position.

Figure 16:
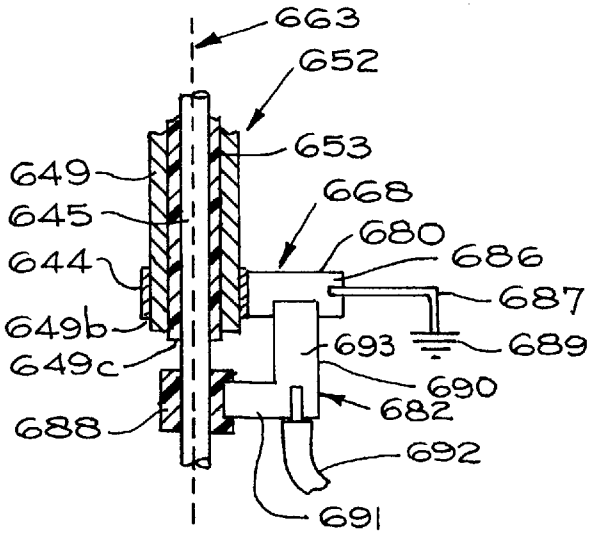
FIG. 16 is a partial side view of an ignition ground switch that may be used in the sixth embodiment of the invention.

FIG. 16 depicts an ignition ground switch that may optionally be used with the sixth embodiment discussed above. In FIG. 16, ignition ground switch 668 is interconnected with the link arm lever assembly 652. In FIG. 16, the ground switch assembly includes an elongated tube shaped guide member 649 having an elongated bore 649*c* extending therethrough about axis 663. The guide member includes a second end 649*b*. The ground switch assembly may also include an interior surface 651 of bore 649*a* being coated with a non-conductive layer 653. Non-conductive layer 653 can be made of rubber or plastic, or any other non-conductive material known in the art. Link arm 645 extends through and slidably engages the non-conductive layer within bore 649*c* about axis 663.

The ignition ground switch 668 includes an upper portion 680 and a lower portion 682. Upper portion 680 includes an upper ground clip 684 attached to the second end of guide member 649*b*. An upper engagement member 686 made of conductive material is attached to upper ground clip 684 and extends substantially horizontally from guide member 649. The conductive material can include conductive metal known in the art, such as iron, steel, aluminum, and copper, or may include other conductive material. A ground wire 687 is connected to the engagement member 686 and extends to a grounding point 689.

Lower portion 682 includes a lower ground clip 688 made of substantially non-conductive material attached to link arm 645. Lower ground clip 688 is attached to link arm 645 at a point below guide member 649 such that when link arm 645 is in the stop or blocking position, the lower ground clip 688 nearly engages the second end 649*b* of guide member 649, and when link arm 645 is in the run or non-blocking position, the lower ground clip 688 is spaced substantially from the second end 649*b* of guide member 649. A substantially L-shaped lower engagement member 690 made of conductive material is attached to lower ground clip 688. Lower engagement member 690 has a first, horizontally extending portion 691, and a second vertically extending portion 693. The conductive material can include conductive metal known in the art, such as iron, steel, aluminum, and copper, or may include other conductive material. An ignition wire 692 is connected to the engagement member 690.

As shown in FIG. 16, when the link arm lever assembly 652 is in the stop or blocking position, the vertically extending portion 693 of lower engagement member 690 engages the upper engagement member 686, and grounds the ignition system of the engine. When the link arm lever assembly 652 is in the run or non-blocking position, the vertically extending portion 693 of lower engagement member 690 does not engage the upper engagement member 686, and the ignition system of the engine is not grounded.

While several embodiments of the present invention have been shown and described, other embodiments will be apparent to those skilled in the art and are within the intended scope of the present invention. The present invention includes any manually-operated means for blocking the flow of fuel or an air/fuel mixture, downstream of the fuel bowl and upstream of the engine intake valve upon engine shutdown. Therefore, the scope of the present invention is to be limited only by the following claims.

I claim:

1. A fuel shutoff system for an internal combustion engine, the engine having a carburetor with a fuel bowl and a fuel nozzle, a throttle valve, a fuel metering device for calibrating an air/fuel mixture, a fuel conduit communicating with the fuel bowl, and a fuel inlet pathway communicating with the fuel nozzle and having one end defined by at least one fuel inlet and another end defined by an inlet end of the fuel nozzle, the shutoff system comprising:

a blocking member distinct from the throttle valve and the fuel metering device, said blocking member being adjacent the fuel inlet pathway and being manually operable to selectively block entry of fuel into the inlet end of the fuel nozzle to substantially prevent passage of fuel through the fuel conduit; and a manually operable control that moves said blocking member to block entry of fuel into the inlet end of the fuel nozzle.

2. The fuel shutoff system of claim 1, wherein said blocking member is selectively positioned adjacent said fuel nozzle in a stop position wherein said blocking member blocks the fuel from flowing into the fuel nozzle, and in a run position wherein said blocking member allows the fuel to flow into the fuel nozzle.

3. The fuel shutoff system of claim 2, wherein said blocking member moves between said stop and run positions in a substantially vertical direction.

4. The fuel shutoff system of claim 2, wherein said blocking member comprises a plunger and wherein said plunger is positioned adjacent to said inlet end of said fuel nozzle when said plunger is in said stop position.

5. The fuel shutoff system of claim 1, wherein said manually operable control is positioned remote from said blocking member.

6. The fuel shutoff system of claim 5, wherein said manually operable control is actuated by a deadman switch.

7. The fuel shutoff system of claim 1, wherein said manually operable control includes a lever;

a cam interconnected between said blocking member and said lever such that operation of said lever selectively moves said cam, said cam causing said blocking member to move between a stop position and a run position; and an actuating assembly interconnecting said control and said blocking member.

8. The fuel shutoff system of claim 7, wherein said manually operable control comprises one of a rotary motion lever, a push-pull motion lever and a pushbutton.

9. The fuel shutoff system of claim 1, wherein said manually operable control includes an actuator comprising at least one of a lever and a switch; and a bowden cable interconnected between said blocking member and said actuator;

wherein operation of said actuator selectively moves said blocking member between a stop position and a run position.

10. The fuel shutoff system of claim 9, wherein said switch is a deadman switch.

11. The fuel shutoff system of claim 9, wherein said manually operable control comprises one of a rotary motion lever, a push-pull motion lever and a pushbutton.

12. The fuel shutoff system of claim 1, wherein said engine also has a throttle control lever that includes said manually operable control.

13. A fuel shutoff system for an internal combustion engine, the engine having a carburetor with a fuel bowl, a throttle valve, a fuel conduit communicating with the fuel bowl and including a fuel nozzle and a throat through which a gas may pass to an intake valve of the engine, and a fuel inlet pathway communicating with the fuel nozzle and having one end defined by at least one fuel jet and another end defined by an inlet end of the fuel nozzle, the shutoff system comprising:

a blocking member adjacent the fuel inlet pathway and manually operable to selectively block entry of fuel into the inlet end of the fuel nozzle to substantially prevent passage of fuel through the fuel conduit, said blowing member being positioned such that no portion of said blocking member intersects the throat.

14. The fuel shutoff system of claim 13, wherein the carburetor further includes a fuel metering device and said blocking member is distinct from the fuel metering device.

15. The fuel shutoff system of claim 13, wherein said blocking member is selectively positioned adjacent the inlet end in a stop position wherein said blocking member blocks the fuel from flowing into the fuel nozzle, and in a run position wherein said blocking member allows the fuel to flow into the fuel nozzle, said blocking member being positioned such that no portion of said blocking member is in the inlet end when said blocking member is in said run position.

16. The fuel shutoff system of claim 15, wherein said blocking member moves between said stop and run positions in a substantially vertical direction.

17. The fuel shutoff system of claim 15, wherein said blocking member comprises a plunger and wherein said plunger is positioned adjacent said inlet end of said fuel nozzle when said plunger is in said stop position.

18. The fuel shutoff system of claim 13, further including a manually operable control for actuating said blocking member to block the fuel conduit.

19. The fuel shutoff system of claim 18, wherein said manually operable control is positioned remote from said blocking member.

20. The fuel shutoff system of claim 19, wherein said manually operable control is actuated by a deadman switch.

21. The fuel shutoff system of claim 18, wherein said manually operable control includes a lever;

a cam interconnected between said blocking member and said lever such that operation of said lever selectively moves said cam, said cam causing said blocking member to move between a stop position and a run position; and an actuating assembly interconnecting said control and said blocking member.

22. The fuel shutoff system of claim 21, wherein said manually operable control comprises one of a rotary motion lever, a push-pull motion lever and a pushbutton.

23. The fuel shutoff system of claim 18, wherein said manually operable control includes an actuator comprising at least one of a lever and a switch; and a bowden cable interconnected between said blocking member and said actuator;

wherein operation of said actuator selectively moves said blocking member between a stop position and a run position.

24. The fuel shutoff system of claim 23, wherein said manually operable control comprises one of a rotary motion lever, a push-pull motion lever and a pushbutton.

25. The fuel shutoff system of claim 18, wherein said engine also has a throttle control lever that includes said manually operable control.

* * * * *

UNITED STATES PATENT AND TRADEMARK OFFICE

CERTIFICATE OF CORRECTION

PATENT NO. : 6,213,083 B1
DATED : April 10, 2001
INVENTOR(S) : James R. Winberg

It is certified that error appears in the above-identified patent and that said Letters Patent is hereby corrected as shown below:

Column 13,
Line 59, delete "fuel inlet" and insert -- fuel jet --.

Column 14,
Line 65, delete "blowing" and insert -- blocking --.

Signed and Sealed this

Twenty-third Day of April, 2002

*Attest:*

*Attesting Officer*

JAMES E. ROGAN
*Director of the United States Patent and Trademark Office*